US010550625B2

(12) United States Patent
Niehausmeier et al.

(10) Patent No.: US 10,550,625 B2
(45) Date of Patent: Feb. 4, 2020

(54) INSULATING BODY FOR MULTI-SHELL CONSTRUCTION ELEMENTS

(71) Applicant: Solarlux GmbH, Melle (DE)

(72) Inventors: Uwe Niehausmeier, Rödinghausen (DE); Werner Helmich, Westerkappeln (DE)

(73) Assignee: Solarlux GmbH, Melle (DE)

( * ) Notice: Subject to any disclaimer, the term of this patent is extended or adjusted under 35 U.S.C. 154(b) by 76 days.

(21) Appl. No.: 15/848,587

(22) Filed: Dec. 20, 2017

(65) Prior Publication Data

US 2018/0179805 A1 Jun. 28, 2018

(30) Foreign Application Priority Data

Dec. 23, 2016 (DE) ..... 10 2016 125 602

(51) Int. Cl.

| | |
|---|---|
| ***E06B 3/263*** | (2006.01) |
| ***E06B 3/273*** | (2006.01) |
| ***E06B 3/62*** | (2006.01) |
| ***E06B 3/58*** | (2006.01) |
| ***E05C 1/00*** | (2006.01) |

(52) U.S. Cl.

CPC ..... *E06B 3/26305* (2013.01); *E05C 1/00* (2013.01); *E06B 3/26303* (2013.01); *E06B 3/273* (2013.01); *E06B 3/5821* (2013.01); *E06B 2003/2639* (2013.01); *E06B 2003/26329* (2013.01); *E06B 2003/26332* (2013.01); *E06B 2003/26352* (2013.01); *E06B 2003/26359* (2013.01); *E06B 2003/26361* (2013.01); *E06B 2003/26389* (2013.01); *E06B 2003/6229* (2013.01); *E06B 2003/6244* (2013.01)

(58) Field of Classification Search

CPC ..... E06B 3/26301; E06B 3/26303; E06B 3/26305; E06B 3/5821; E06B 2003/26314; E06B 2003/26329; E06B 2003/26332; E06B 2003/26352; E06B 2003/26359; E06B 2003/26361; E06B 2003/26389; E06B 2003/2639; E06B 2003/6229

See application file for complete search history.

(56) References Cited

U.S. PATENT DOCUMENTS 7,104,019 B2 9/2006 Brunnhofer

FOREIGN PATENT DOCUMENTS

| | | | | |
|---|---|---|---|---|
| CA | 1 262 077 | | 10/1989 | |
| CA | 1262077 A | * | 10/1989 | ..... E05D 3/12 |
| CH | 685401 A5 | * | 6/1995 | ..... E06B 1/325 |
| DE | 2714378 B1 | * | 9/1978 | ..... E06B 3/26305 |

(Continued)

*Primary Examiner* — Christine T Cajilig

(74) *Attorney, Agent, or Firm* — Gudrun E. Huckett

(57) ABSTRACT

An insulating body for multi-shell construction elements for spacing apart and thermally separating at least two profiled section elements relative to each other has a base member with a first side and a second side opposite the first side. Fastening projections are arranged on the first and second sides of the base member and secure the insulating body in receptacles of the profiled section elements. At least the first side has two of the fastening projections. The base member has a hollow chamber with an inner guiding contour for receiving and guiding fitting parts. A multi-shell construction element with at least two profiled section elements is provided with at least one such insulating body.

9 Claims, 5 Drawing Sheets

(56) References Cited

FOREIGN PATENT DOCUMENTS

| | | | | | |
|---|---|---|---|---|---|
| DE | 32 00 078 | | | 7/1983 | |
| DE | 39 43 123 | | | 6/1991 | |
| DE | 100 01 425 | | | 7/2000 | |
| DE | 10006612 | A1 | * | 8/2001 | ..... E06B 3/26301 |
| DE | 10 2014 012 894 | | | 3/2016 | |
| DE | 10 2015 012 717 | | | 4/2017 | |
| EP | 2 708 693 | | | 3/2014 | |
| FR | 2957965 | A1 | * | 9/2011 | ..... E06B 1/62 |
| FR | 3005091 | A1 | * | 10/2014 | ..... E06B 3/263 |
| FR | 3067740 | A1 | * | 12/2018 | ..... E06B 3/26301 |
| WO | WO-8403326 | A1 | * | 8/1984 | ..... E06B 3/273 |
| WO | WO-2011154300 | A2 | * | 12/2011 | ..... E06B 3/26301 |
| WO | WO-2018108268 | A1 | * | 6/2018 | ..... E06B 3/26305 |

* cited by examiner

Fig. 1a
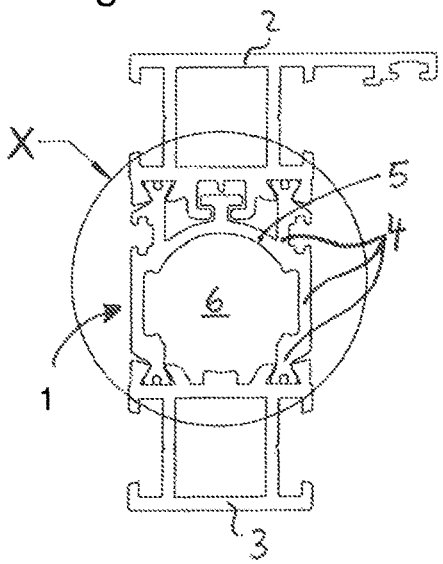
Fig. 2a
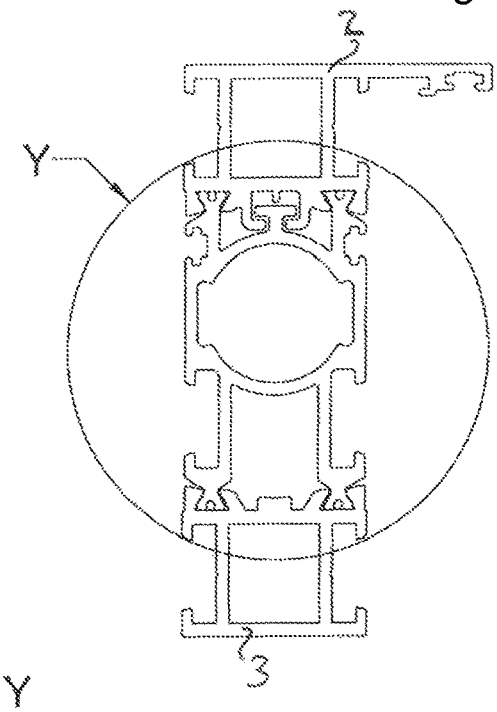
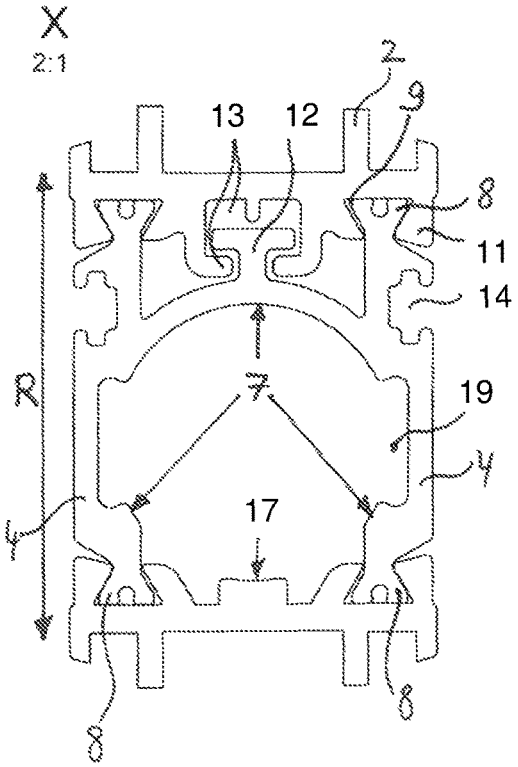
Fig. 1b
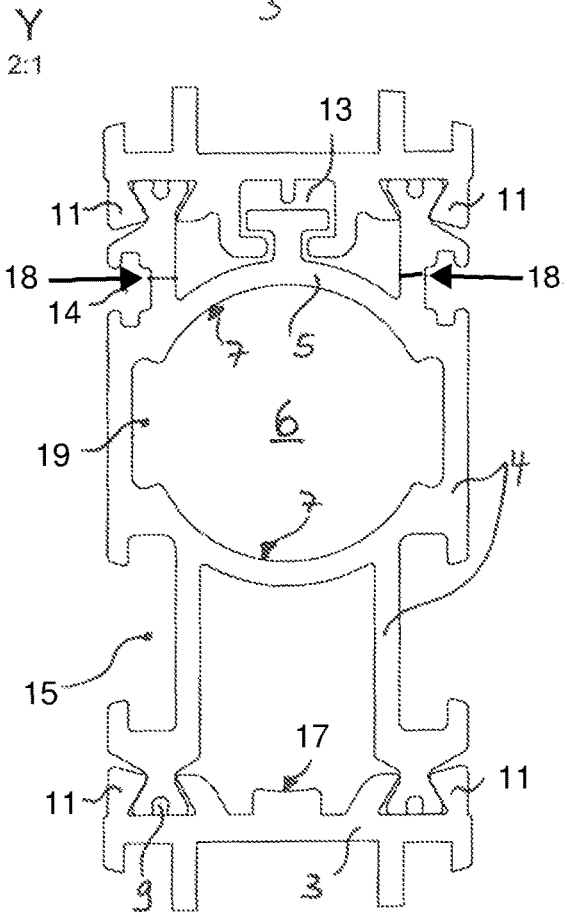
Fig. 2b

INSULATING BODY FOR MULTI-SHELL CONSTRUCTION ELEMENTS

BACKGROUND OF THE INVENTION

The invention relates to an insulating body for multi-shell construction elements such as doors, windows, facade elements or composite sections, for spacing apart and thermally separating at least two profiled section elements relative to each other, comprising fastening projections provided on opposite sides for fixation at corresponding receptacles of the profiled section elements.

The invention further relates to such a construction element with insulating body, in particular a framed glass panel, with at least two profiled section elements that are spaced apart from each other by an insulating body.

In multi-shell construction elements such as doors, windows, facade elements, other composite sections or the like, it is conventional to space apart and thermally separate by means of insulating bodies profiled section elements from each other that form an outer shell and an inner shell and preferably are in the form of light metal sections of aluminum or aluminum alloys. In practice, usually insulating stays are used, as disclosed, for example, in U.S. Pat. No. 7,104,019 B2. The known insulating stays have at both opposite sides or ends fastening projections, referred to also as fastening legs, that widen toward their ends and are held in a complementary receptacles such as, for example, undercut grooves of the profiled section elements. For a fixed connection with the profiled section elements, at least one wall of the receiving groove which is initially produced with excess size is pressed with deformation thereof against the fastening projection contained therein—this is the so-called curling process—and, in this way, the insulating body is held not only in the longitudinal direction of the stay but also in a non-slidable way within the groove.

In general, several insulating stays are used that are spatially tightly neighboring each other. Also, it is required in many construction positions to provide additional guides or receptacles for fitting parts such as locking elements. The plurality of required components result in a plurality of assembly steps.

SUMMARY OF THE INVENTION

It is an object of the present invention to simplify the configuration of multi-shell construction elements.

In accordance with the invention, this is achieved in regard to the insulating body in that at least one side of the insulating body comprises at least two fastening projections and the insulating body forms a hollow chamber with an inner guiding contour which is designed for receiving and guiding fitting parts.

This is further achieved in connection with the multi-shell construction element in that the construction element comprises an insulating body according to the invention.

By configuring the insulating body with at least two fastening projections on at least one side so that at least two fastening projections of the same insulating body are engaging one of the two profiled section elements to be connected, the two profiled section elements are not only spaced apart from each other but are also secured against tilting. For this purpose, up to now at least two insulating stays are required in practice. Since the insulating body according to the invention also forms a hollow chamber that comprises an inner guiding contour for receiving and guiding fitting parts, the requirement for separate components between the profiled section elements that receive the fitting parts, for example, locking elements, is eliminated. The hollow chamber which is formed by the one-piece (monolithic) insulating body must not be closed mandatorily for this purpose. It is sufficient when the guiding contour provides for a reliable guiding action of the received fitting part, for example, a locking pin; optionally, guiding can be realized with adjoining walls of the connected profile section elements.

In particular window frames and door frames are often of a multi-part configuration, as described above, and require in general also fitting parts for locking, for example, locking pins. The latter have usually a circular cross section or rods with a contour that has at least partially the shape of a circular circumference segment. Preferably, the guiding contour of the insulating body has therefore also areas that have the shape of a circular circumference segment.

A preferred embodiment of the insulating body comprises a base member of at least two spaced apart insulating stays which are extending from one profiled section element to the other and are connected transverse thereto by a transverse stay which at least partially forms the guiding contour. The transverse stay can be of a dome shape so as to bulge toward one of the profiled section elements and forms thus not only the guiding contour but also imparts to the insulating body a high stability.

The multi-functionality of the insulating body according to the invention can be further improved in that it is provided with one or a plurality of outwardly open receptacles for additional functional elements. These receptacles which are preferably designed as undercut grooves can receive, for example, seals, fastening elements for adjoining components, fixations or other fitting elements.

In the interior of the insulating body, it is also advantageous to provide one or a plurality of recesses, preferably with planar surface, in which the projections of fastening elements can be accommodated without disturbance. These recesses should therefore be so deep that projections as, for example, the heads or other parts of sheet metal nuts, blind rivets or countersunk rivets will not project into the guiding contour and thus will not contact fitting parts that are to be received in the guiding contour.

The insulating body moreover may comprise one or a plurality of outwardly projecting guiding stays; such a guiding stay can be provided in addition to the at least three fastening projections of the insulating body or can also replace one of the fastening projections. The guiding stay can thus also be a "fastening projection".

Preferred is however an embodiment in which a guiding stay is arranged on one side of the insulating body, facing one of the profiled section elements, between two fastening projections. In this way, an additional utilization is provided which will be explained with the aid of the construction element which is also claimed. In an advantageous compact and well utilizable construction, the fastening projection or the fastening projections on one side of the insulating body project father outwardly than the guiding stay.

By means of the described insulating body, a novel multi-shell construction element can be formed that has a reduced number of components with increased functionality. When in this context in the guiding contour of the insulating body, for example, a locking element is slidably guided, the need for further guiding components is eliminated. The construction element can therefore be made slimmer than is conventional; this is in particular advantageous for framed glass panels when the facing width (elevation width) of the profiled section elements forming the frame is to be reduced.

When using an insulating body with an outwardly projecting guiding stay; with a guiding stay arranged between two fastening projections on one side of the insulting body; with fastening projection(s) on one side of the insulating body that project(s) farther outwardly than the guiding stay, a further problem that is encountered in particular in case of tall windows or glass doors can be solved. Multi-shell construction elements, in particular when of a dark color, are subject to thermal expansion when exposed to sun irradiation on only one side; this can lead to the construction component deforming by a significant amount. In practice, in the past the insulating stays that are used are separated again in the upper area of the construction element at one of the two profiled section elements. In order for the profiled section elements to still be connected, they are secured by displaceable clamps. This means additional assembly expenditure, still with reduced strength.

A construction element according to the invention provides that the guiding stay of the insulating body is slidable in one of the profiled section elements but is captively secured therein while the existing fastening projections are initially non-slidably and fixedly connected to the profiled section elements. In the areas in which thermal deformation occurs, on one side of the insulating body the fastening projection or fastening projections can be separated from the insulating body. They can thus remain within the profiled section elements. However, the guiding stay is not separated and reliably secures, even within the now slidable area, the profiled section elements to each other.

In a multi-shell construction element according to the invention, the insulating body and at least one of the profiled section elements can also supplement each other in such a way that the guiding contour, which is predetermined by the insulating body, can be continued or extended by a guiding contour area provided at the profiled section element. This is in particular useful in construction elements of minimal thickness that require insulating bodies of a corresponding minimal depth.

Further advantages and details result from the claims and the embodiments illustrated in the drawing to be explained in the following.

BRIEF DESCRIPTION OF THE DRAWING

FIG. 1*a* shows an insulating body according to the invention, installed between two profiled section elements, and FIG. 1*b* shows the detail X in an enlarged view.

FIG. 2*a* shows an insulating body of a different embodiment in an illustration corresponding to that of FIG. 1*a* and FIG. 2*b* shows the detail Y in an enlarged view.

DESCRIPTION OF THE PREFERRED EMBODIMENTS

Figure 3:
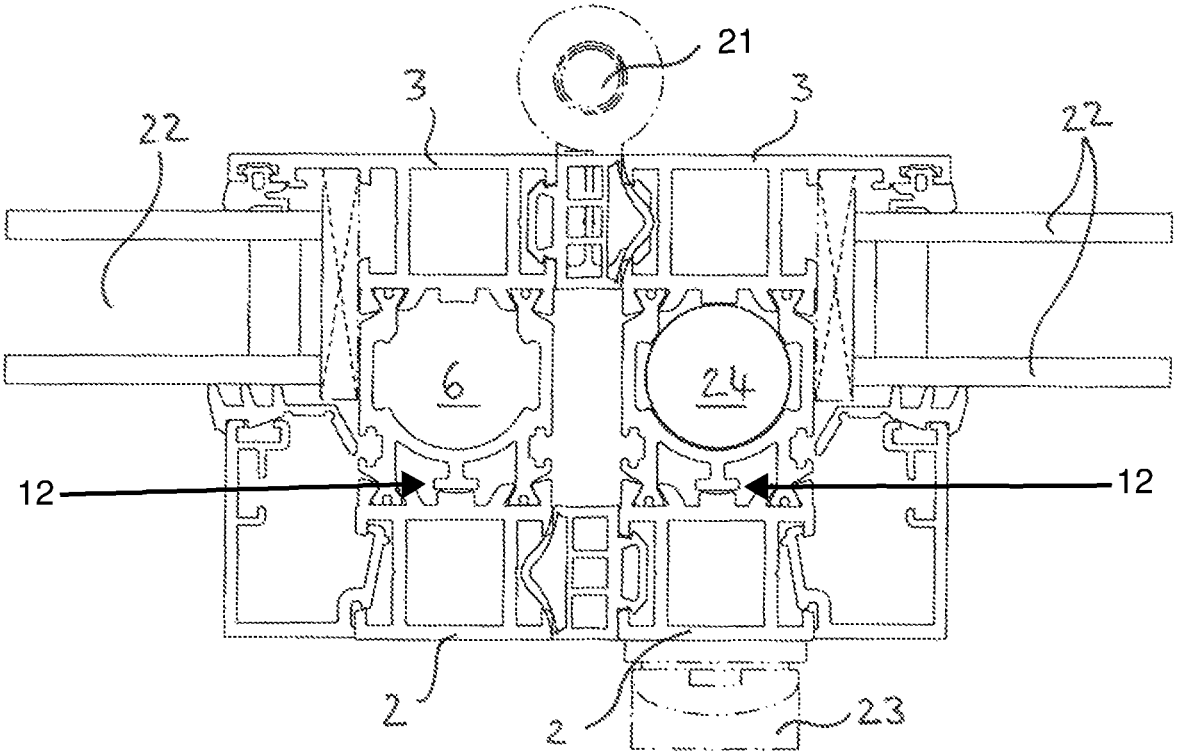
FIG. 3 is a section view of a multi-shell construction element with inserted insulating bodies.

FIGS. 1*a* and 1*b* show an embodiment of an insulating body 1 according to the invention that connects two profiled section elements 2, 3 but also separates them thermally and keeps them spaced apart. The illustrated insulating body 1 is comprised substantially of a monolithic base member with two insulating stays 4 and a transverse stay 5, wherein the insulating stays 4 are extending from the profiled section element 2 to the other profiled section element 3 and are connected transverse to the main extension direction R of the insulating stays 4 by the transverse stay 5. Together, the insulating stays 4 and the transverse stay 5 define a hollow chamber 6 which comprises an inner guiding contour 7. The latter is designed due to its shape for receiving and guiding fitting parts, as will be explained in the following by means of FIGS. 3 and 5 to 7.

The insulating body 1 has on opposite sides, i.e., each side facing one of the two profiled section elements 2, 3, respectively, two fastening projections 8 which are formed as outwardly widening fastening legs and engage receptacles 9 of the profiled section elements 2, 3. The fastening projections 8 are fixedly connected in practice in that pressure is applied to the exterior sides 11 of the receptacles 9 and cause deformation so that the exterior sides 11 contact tightly the fastening projections 8 and secure them such that they are non-slidable. This method is referred to as curling.

In addition, the insulating body 1 comprises a guiding stay 12 which is guided in a matching guiding receptacle 13 of the profiled section element 2 so as to be slidable but captively secured. For this purpose, the illustrated embodiment with a T-shaped guiding stay 12 and a substantially C-shaped guiding receptacle 13 are beneficial. Positioning of the guiding stay 12 between the fastening projections 8 and selecting its length so as to be reduced relative to the fastening projections 8 has the advantage that during curling of the fastening projections 8 pressure is not indirectly applied to the guiding receptacle 13 so that the sliding action of the guiding stay 12 is maintained. In areas in which, for example, by thermal action, the profiled section element 2 is deformed relative to the profiled section element 3, the non-slidable connection of the insulating body 1 can be released in such an embodiment from the profiled section element 2 in that the connection of the fastening projections 8 is separated, at least partially, from the remaining part of the insulating body 1, for example, at the position that is indicated in FIG. 2*b* with reference numeral 18. The guiding stay 12 continues to reliably secure in this context the profiled section element 2 on the profiled section element 3 but so as to be slidable perpendicular to the drawing plane.

The insulating body 1 illustrated in FIGS. 1*a*-1*b* and 2*a*-2*b* have in addition outwardly open receptacles 14, 15 into which additional functional elements can be inserted. For example, rubber seals, fasteners or further fittings can be received therein. While the hollow chamber 6 of the insulating body 1 is configured open toward the profiled section element 3 (FIGS. 1*a*, 1*b*), the insulating body 1 of FIGS. 2*a*, 2*b* has a closed hollow chamber. This is possible due to the extended embodiment of the insulating body 1 as shown in FIGS. 2*a*-2*b* which is provided for thicker construction elements. In FIGS. 2*a*, 2*b*, the entire guiding contour 7 is thus formed by the wall of the hollow chamber 6 while in FIGS. 1*a*, 1*b* a guiding contour area 17 of the profiled section element 3 of a circular circumference segment shape takes on this partial task.

Both embodiments of the insulating body (FIGS. 1*a*, 1*b*; 2*a*, 2*b*) have recesses 19 in the guiding contour 7. They serve preferably for receiving sheet metal nuts, blind rivets, countersunk rivets or similar fastening means and are so deep that the fastening element received therein does not project past an imaginary extension of the guiding contour 7. Advantageously, the outwardly open receptacles 14 and optionally 15 as well as the recesses 19 along the insulating stays 4 are arranged alternatingly so that the stay material is not reduced improperly at any position. By appropriate proper positioning, the insulating body 1 can thus be embodied with minimal material use and therefore can be designed to be accordingly lightweight but still stable.

FIGS. 3-7 show embodiments of multi-shell construction elements employing the afore described insulating body 1. In FIG. 3, two glass panels that are connected by a hinge 21 are shown. The profiled section elements 2, 3 support here double pane glazing 22. Thermally, the profiled sections 2, 3 are separated from each other by the insulating body 1. The glass panel to the right in the illustration is also lockable by means of a grip 23 which acts on a locking pin 24 and can cause it to slide in a direction perpendicular to the drawing plane. The locking pin 24 is guided as a fitting in the hollow chamber 6 of the insulating body 1. In the embodiment according to FIG. 3, the guiding stay 12 does not serve for slidably guiding the insulating body 1 but supports the stay 12 only against the profiled section element 2.

Figure 4:
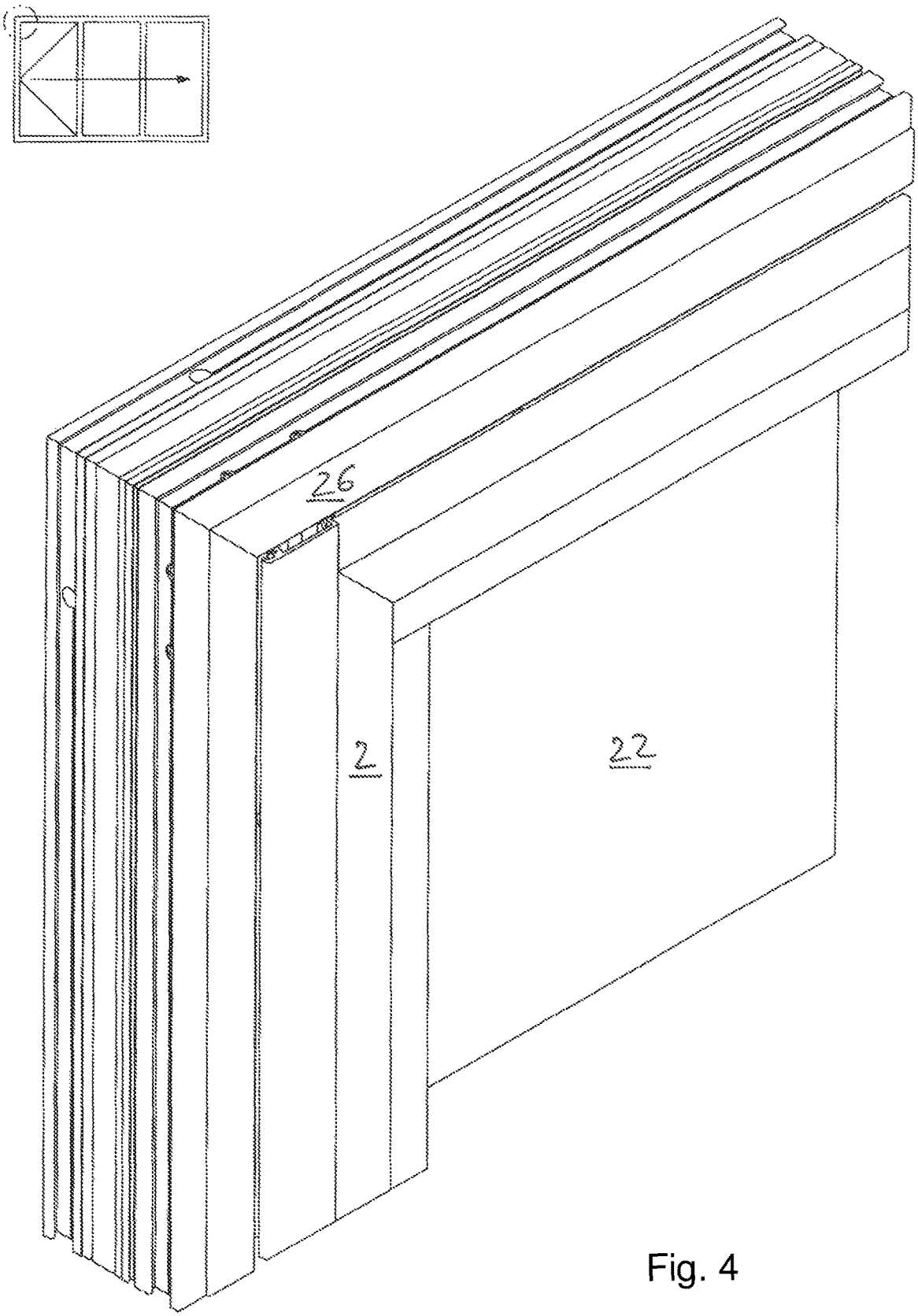
FIG. 4 shows a detail of a glass folding device.
Figure 5:
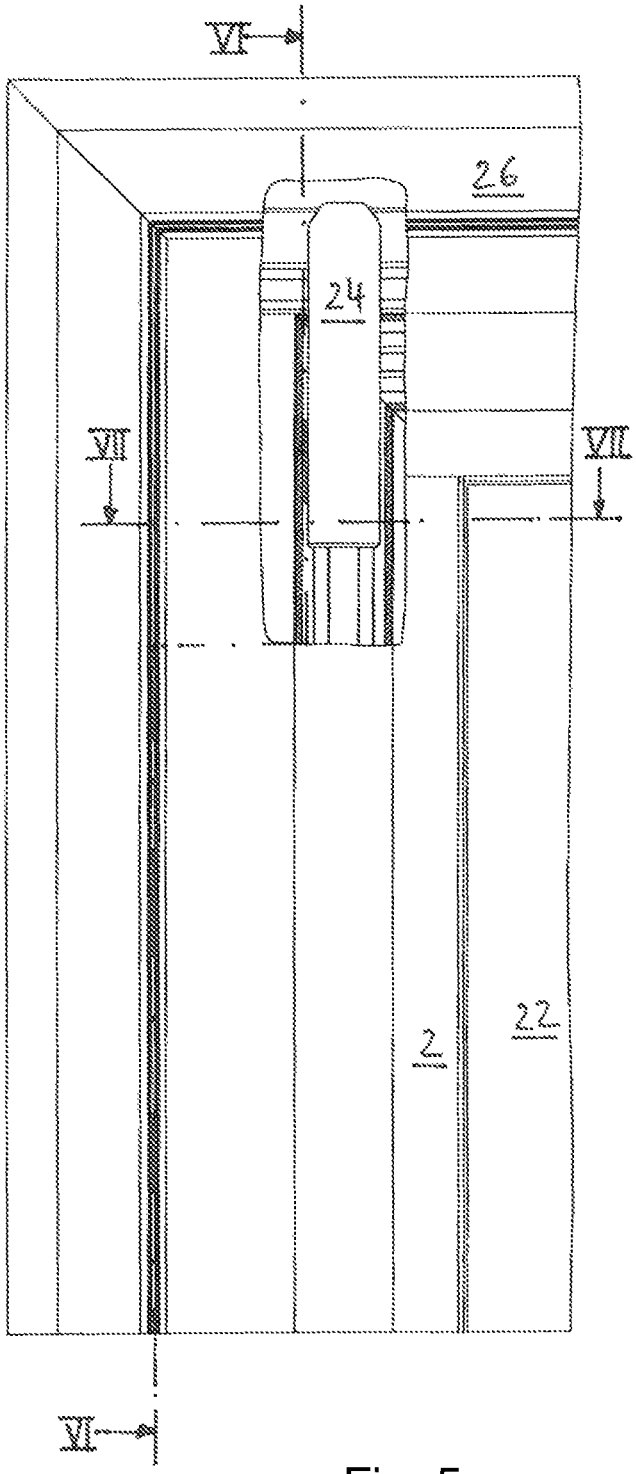
FIG. 5 shows the glass folding device detail of FIG. 4 in a partially broken away front view.
Figure 6:
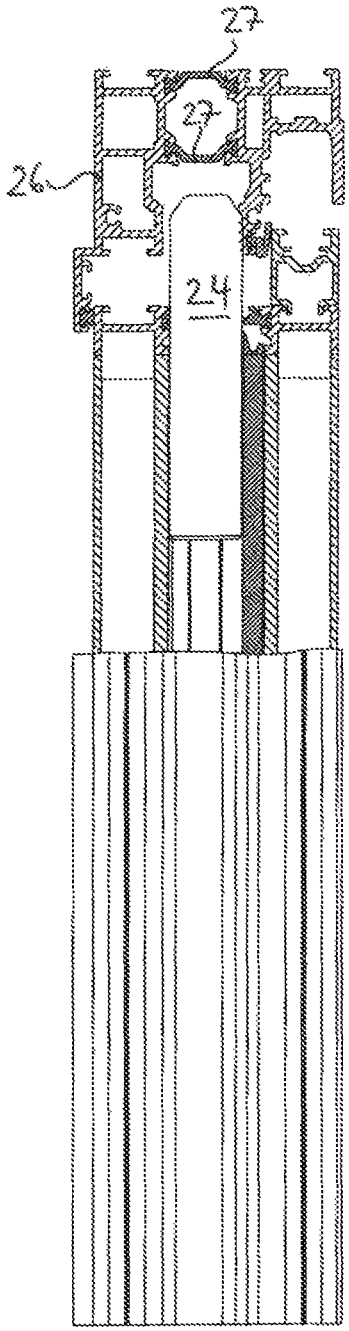
FIG. 6 shows a section view along section line VI-VI of the glass folding device detail illustrated in FIG. 5.
Figure 7:
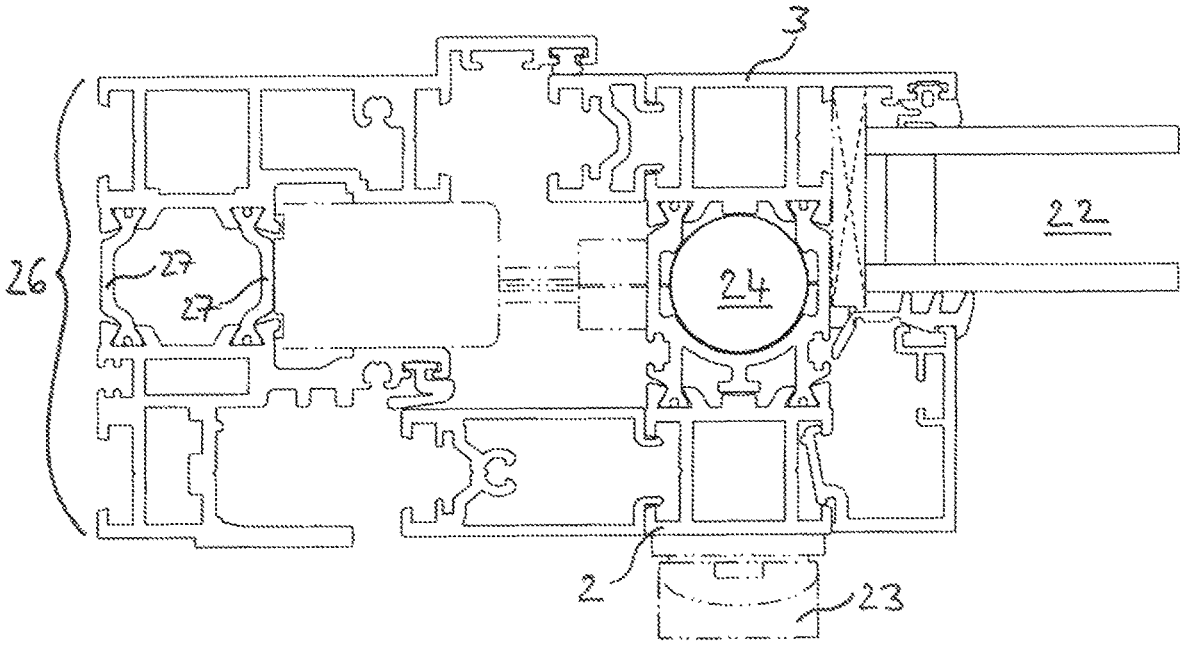
FIG. 7 shows a section view along section line VII-VII of the glass folding device detail illustrated in FIG. 5.

FIG. 4 shows the upper left corner of a three-panel glass folding device as it is illustrated in the upper part of the Figure as a pictogram. FIGS. 4 through 6 serve only for illustrating how, for example, the locking pin 24 is acting in the construction element. It engages, as shown in FIGS. 5 and 6, in a part of an upper frame section 26. FIG. 7 ties in with FIGS. 1*a*, 1*b* to 3 and shows the insulating body 1 with the locking pin 24 guided therein similar to the illustration in FIG. 3. In the area of the frame section 26, the configuration of conventional insulating stays 27 can be seen also.

The specification incorporates by reference the entire disclosure of German priority document 10 2016 125 602.1 having a filing date of Dec. 23, 2016.

While specific embodiments of the invention have been shown and described in detail to illustrate the inventive principles, it will be understood that the invention may be embodied otherwise without departing from such principles.

What is claimed is:

1. An insulating body for multi-shell construction elements for spacing apart and thermally separating at least two profiled section elements relative to each other, the insulating body comprising:

a base member comprising a first side and a second side opposite the first side;

fastening projections arranged on the first and second sides of the base member and configured to secure the insulating body in receptacles of the at least two profiled section elements;

wherein at least the first side comprises two of the fastening projections;

the base member comprising a hollow chamber with an inner guiding contour configured for receiving and guiding fitting parts;

wherein the base member comprises an outwardly projecting guiding stay arranged on the first side between the two fastening projections, wherein at least one of the two fastening projections is separated at least partially from the at least one insulating body;

wherein the two fastening projections on the first side project father outwardly than the guiding stay.

2. The insulating body according to claim 1, wherein the inner guiding contour comprises circular circumference segment areas.

3. The insulating body according to claim 1, wherein the base member is a monolithic body comprising two spaced apart insulating stays and at least one transverse stay connecting the two spaced apart insulating stays to each other, wherein the at least one transverse stay is provided at least partially with the inner guiding contour.

4. The insulating body according to claim 1, wherein the base member comprises at least one outwardly open receptacle configured to receive functional elements selected from the group consisting of fastening elements, fixation elements, seals, and fittings.

5. The insulating body according to claim 1, wherein the inner guiding contour comprises at least one recess such that projections of fastening elements can be sunken therein so as not to contact a fitting part received in the inner guiding contour.

6. An insulating body for multi-shell construction elements for spacing apart and thermally separating at least two profiled section elements relative to each other, the insulating body comprising:

a base member comprising a first side and a second side opposite the first side;

fastening projections arranged on the first and second sides of the base member and configured to secure the insulating body in receptacles of the at least two profiled section elements;

wherein at least the first side comprises two of the fastening projections;

the base member comprising a hollow chamber with an inner guiding contour configured for receiving and guiding fitting parts;

wherein the base member comprises an outwardly projecting guiding stay;

wherein the guiding stay is arranged adjacent to one of the fastening projections and points in the same direction as said one fastening projection, wherein said one fastening projection projects father outwardly than said guiding stay, wherein said one fastening projection is separated at least partially from the at least one insulating body.

7. A multi-shell construction element, comprising at least two profiled section elements and at least one insulating body connected to and spacing apart the at least two profiled section elements;

wherein the at least one insulating body comprises: a base member comprising a first side and a second side opposite the first side; fastening projections arranged on the first and second sides of the base member and configured to secure the insulating body in receptacles of the at least two profiled section elements; wherein at least the first side comprises two of the fastening projections; and wherein the base member comprises a hollow chamber with an inner guiding contour configured for receiving and guiding fitting parts;

wherein the at least one insulating body comprises at least one guiding stay slidably but captively secured in one of the at least two profiled section elements, wherein the fastening projections of the at least one insulating body are fixedly connected, at least over sections thereof, non-slidably to the profiled section elements;

wherein at least one of the fastening projections arranged adjacent to the guiding stay is separated at least partially from the at least one insulating body.

8. The construction element according to claim 7, comprising a locking element guided slidably in the at least one insulating body by the inner guiding contour of the at least one insulating body.

9. The construction element according to claim 7, wherein the inner guiding contour of the at least one insulating body at least partially is extended by a guiding contour area provided on one of the at least two profiled section elements.

* * * * *